US005550523A

United States Patent [19]

Rouet et al.

[11] Patent Number: 5,550,523

[45] Date of Patent: Aug. 27, 1996

[54] INDUCTOR

[75] Inventors: Pascal Rouet, Gouy; Bernard Delvart, Heudreville Sur Eure, both of France

[73] Assignee: U.S. Philips Corporation, New York, N.Y.

[21] Appl. No.: 295,444

[22] Filed: Aug. 24, 1994

[30] Foreign Application Priority Data

Sep. 1, 1993 [FR] France ..... 9310428

[51] Int. Cl.[6] ..... H01F 27/24

[52] U.S. Cl. ..... 336/221; 323/323 EC; 323/24 R; 336/221; 336/233; 336/225; 336/195

[58] Field of Search ..... 336/221, 233, 336/223, 195, 69; 333/24 R; 323/78

[56] References Cited

U.S. PATENT DOCUMENTS 3,982,814 9/1976 Kaiserwerth et al. ..... 323/78

4,638,282 1/1987 Ellison ..... 336/185

4,641,115 2/1987 Bailey ..... 333/181

*Primary Examiner*—Leo P. Picard

*Assistant Examiner*—G. R. Lord

*Attorney, Agent, or Firm*—Edward Blocker

[57] ABSTRACT

The inductor has a winding arranged on a straight magnetic core formed by, for example, a ferrite cylinder (4) accommodated in a cylinder (1) made of a moulded plastics material and having a longitudinal groove in its outer cylindrical surface, in which groove a bar (2) of an electrically resistive material is mounted, the bar being fixed underneath the winding wire (3). The inductor is used for the injection of low-frequency current into a cable of a CATV system.

23 Claims, 1 Drawing Sheet

INDUCTOR

BACKGROUND OF THE INVENTION

1. Field of the Invention

The invention relates to an inductor comprising a winding of electrical wire wound on a straight magnetic core.

Such an inductor is used for injecting a low-frequency current into a cable of a television distribution system in order to power various devices.

2. Description of the Related Art

An inductor intended for the above-mentioned use has comparatively large dimensions because it should allow the passage of substantial currents (of approximately ten amperes). Stray capacitances between turns and also relative to the environment are therefore annoying because they give rise to various resonant frequencies in the inductance characteristic, which frequencies are situated within the passband of television signals. This can be remedied by damping the resonances by means of damping resistors. It has been proposed, for example, to divide the winding into a number of parts, a resistor being connected in parallel with each of these parts. However, this is an expensive method.

SUMMARY OF THE INVENTION

It is an object of the invention to provide a simple, inexpensive and effective solution to this problem.

To this end an inductor in accordance with the invention is characterised in that it comprises a bar made of an electrically resistive material, which bar is interposed between the winding and the core, the winding is formed by non-contiguous turns of a bare wire, and the wire is in contact with the bar.

Herein "electrically resistive" is to be understood to mean that the material of the bar is neither an insulator nor a good conductor but in between the two.

Preferably, the core comprises at least one external cylindrical part of a plastics material in whose surface a longitudinal groove is formed in which the bar is mounted, and the cross-section of the bar in relation to that of the groove is dimensioned in such a manner that a part of the bar extends outside the groove so as to contact the winding wire.

The cylinder of a plastics material preferably accommodates at least one ferrite cylinder.

Moreover, it is advantageous if the cylinder of a plastics material has a helical groove in its outer cylindrical surface.

By means of this groove the wire can be guided during winding and can be kept in place subsequently.

The bar is made of, for example, an insulating material loaded with a conductive powder, for example silicone loaded with a carbon powder.

BRIEF DESCRIPTION OF THE DRAWINGS

These and other more detailed aspects of the invention will become apparent from the following description of a non-limitative embodiment.

DESCRIPTION OF THE PREFERRED EMBODIMENTS

Figure 1:
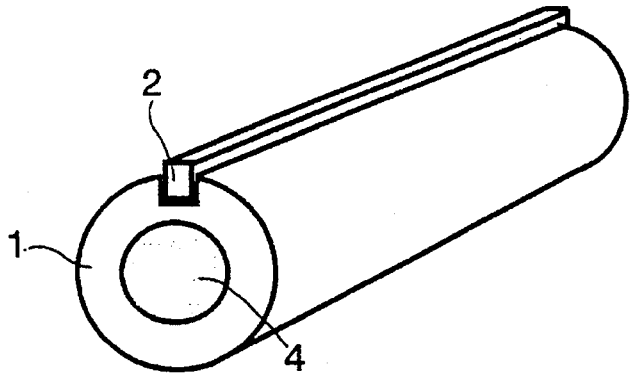
FIG. 1 is a perspective view of a core for an inductor in accordance with the invention.

The core of an inductor in accordance with the invention is shown in FIG. 1 and comprises at least one ferrite cylinder 4 around which a cylinder 1 of a plastics material has been moulded.

Figure 2:
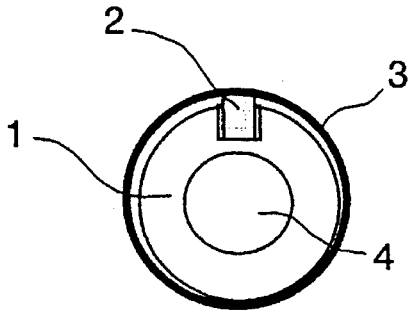
FIG. 2 is a cross-sectional view of an inductor in accordance with the invention.

The surface of the last-mentioned cylinder is formed with a longitudinal groove, for example of rectangular cross-section, in which a bar 2 made of an electrically resistive material is mounted, which bar is also of rectangular cross-section and is dimensioned in such a manner in relation to the groove that a part of the bar is situated outside the groove. The cross-sectional view in FIG. 2 shows the core of FIG. 1 in cross section and also shows one turn of winding wire 3, for example of tinned copper, surrounding the plastics cylinder 1. The wire 3 comes into contact with the bar 2 when it is passed around the bar. The bar 2 is made of, for example, silicone loaded with a conductive carbon powder. The best resistivity can readily be determined by experiment.

Figure 3:
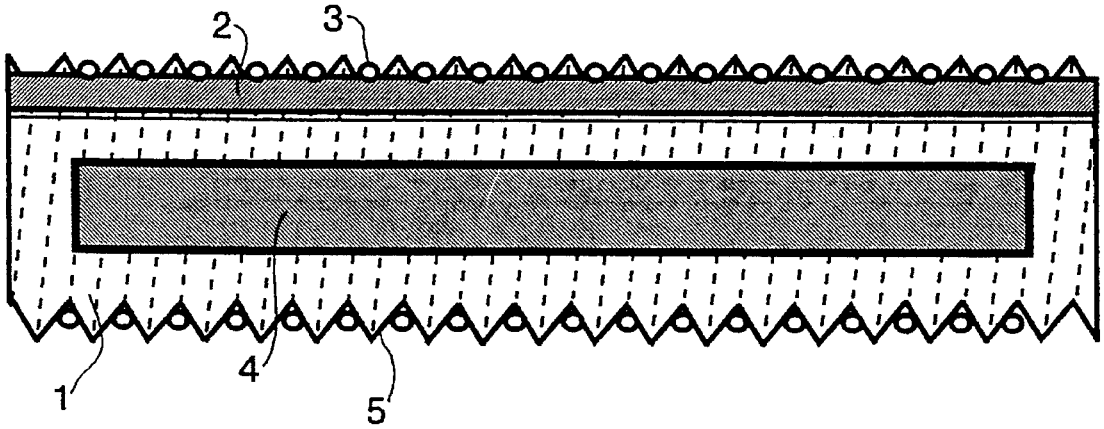
FIG. 3 is an axial sectional view of another inductor in accordance with the invention.

The sectional view in FIG. 3 shows another embodiment in which the plastics cylinder 1 has a helical groove 5 in its outer cylindrical surface and the plastics cylinder 1 fully encloses the ferrite cylinder 4. This groove not only enables the wire to be guided during winding and to be kept in place subsequently but also ensures that the turns of the winding are non-contiguous. However, a winding with non-contiguous turns can also be realised without the use of this groove, as shown in FIGS. 1 and 2. The wire is bare, i.e. not covered with an insulator, and each turn 3 contacts the bar 2. The wire is in contact with and slightly pressed into the bar because the bar is made of a slightly elastic material.

In this way a resistance is connected in parallel with each turn of the coil and the damping is more effective owing to the distributed damping resistance.

We claim:

1. An inductor comprising a winding of electrical wire wound on a straight magnetic core, characterised in that it comprises a bar made of an electrically resistive material, which bar is interposed between the winding and the core, the winding is formed by non-contiguous turns of a bare wire, and the wire is in contact with the bar.

2. An inductor as claimed in claim 1, characterised in that the core comprises at least one external cylindrical part of a plastics material in whose surface a longitudinal groove is formed in which the bar is mounted, and the cross-section of the bar in relation to that of the groove is dimensioned in such a manner that a part of the bar extends outside the groove so as to contact the winding wire.

3. An inductor as claimed in claim 2, characterized in that the bar is made of an insulating material loaded with a conductive powder.

4. An inductor as claimed in claim 3, characterized in that the electrical wire consists of tinned copper.

5. An inductor as claimed in claim 2, characterized in that the electrical wire consists of tinned copper.

6. An inductor as claimed in claim 2, characterised in that the cylinder of a plastics material accommodates at least one ferrite cylinder.

7. An inductor as claimed in claim 6, characterized in that the bar is made of an insulating material loaded with a conductive powder.

8. An inductor as claimed in claim 7, characterized in that the electrical wire consists of tinned copper.

9. An inductor as claimed in claim 6, characterized in that the electrical wire consists of tinned copper.

10. An inductor as claimed in claim 2, characterised in that the cylinder of a plastics material has a helical groove in its outer cylindrical surface.

11. An inductor as claimed in claim 10, characterized in that the bar is made of an insulating material loaded with a conductive powder.

12. An inductor as claimed in claim 11, characterized in that the electrical wire consists of tinned copper.

13. An inductor as claimed in claim 10, characterized in that the electrical wire consists of tinned copper.

14. An inductor as claimed in claim 1, characterised in that the bar is made of an insulating material loaded with a conductive powder.

15. An inductor as claimed in claim 14, characterized in that the electrical wire consists of tinned copper.

16. An inductor as claimed in claim 14, characterised in that the insulating material is silicone.

17. An inductor as claimed in claim 16, characterized in that the conductive powder consists of carbon.

18. An inductor as claimed in claim 17, characterized in that the electrical wire consists of tinned copper.

19. An inductor as claimed in claim 16, characterized in that the electrical wire consists of tinned copper.

20. An inductor as claimed in claim 14, characterised in that the conductive powder consists of carbon.

21. An inductor as claimed in claim 20, characterized in that the electrical wire consists of tinned copper.

22. An inductor as claimed in claim 1, characterised in that the electrical wire consists of tinned copper.

23. An inductor as claimed in claim 22, characterized in that the electrical wire consists of tinned copper.

* * * * *